10/20/87 OR 4,700,626

United States Patent [19]

Iwamoto et al.

[11] Patent Number: 4,700,626

[45] Date of Patent: Oct. 20, 1987

[54] REVERSING GRIPPER OF ONE SIDE AND PERFECTING PRINTING PRESS

[75] Inventors: Masayuki Iwamoto; Setsuo Araki; Yasuo Sone, all of Shizuoka, Japan

[73] Assignee: Shinohara Machinery Co., Ltd., Shizuoka, Japan

[21] Appl. No.: 833,325

[22] Filed: Feb. 24, 1986

[51] Int. Cl.[4] ..... B41F 21/20; B41F 3/40

[52] U.S. Cl. ..... 101/230; 101/411

[58] Field of Search ..... 101/230, 231, 409, 410–411; 271/82, 277, 247

[56] References Cited

U.S. PATENT DOCUMENTS

| | | | |
|---|---|---|---|
| 3,537,391 | 11/1970 | Mowry | 101/183 |
| 3,899,970 | 8/1975 | Jurny et al. | 101/230 |
| 4,120,244 | 10/1978 | Wirz | 101/409 |

*Primary Examiner*—J. Reed Fisher

*Attorney, Agent, or Firm*—Ladas & Parry

[57] ABSTRACT

A reversing gripper apparatus of a one side/perfecting printing press is disclosed. This reversing gripper apparatus comprises a receiving portion wherein a gripper pad fixed to the external circumference of a reversing cylinder grips a sheet of paper in combination with gripper members and a space for withdrawal, the gripper members comprise a combination of a master gripper provided on a common shaft and an auxiliary gripper opposed to the master gripper, the master gripper is formed with a width sufficient to cover the receiving portion of the gripper pad and the point of the auxiliary gripper at the same time and is controlled by a common shaft, and the auxiliary gripper has such a width as to be partly opposed to the width of the master gripper and is controlled with the common shaft as the center. By adopting this structure, the gripping function, register accuracy, and the gripping force of the reversing gripper apparatus are greatly increased.

3 Claims, 9 Drawings

REVERSING GRIPPER OF ONE SIDE AND PERFECTING PRINTING PRESS

BACKGROUND OF THE INVENTION

A. Field of the Invention

The present invention relates to a sheet-fed rotary press for one side/perfecting printing, and particularly to a reversing gripper appratus provided on a reversing cylinder which composes a paper transfer means.

B. Description of the Prior Art

A sheet-fed rotary press for one side and perfecting printing is adapted for multicolor printing of two or more colors on one side of a sheet of paper or for printing of one or more colors on each of two sides of a sheet of paper. Such presses are capable of wide application and are thus winning high public favor.

This one side/perfecting printing press comprises a plurality of printing units which are connected by a paper transfer means comprising paper transfer cylinders, double-diameter cylinders, and reversing cylinders. These papar transfer means cooperatively effect the paper transfer and paper reversing which is required for perfecting printing.

Namely, in the case of one-side printing, a gripper at the front end of the double-diameter cylinder grips the front edge of a sheet and makes the reversing gripper of the reversing cylinder grip the front edge at a point of contact with the reversing cylinder. The reversing gripper then rotates together with the reversing cylinder while gripping the front edge of the sheet and delivers it to the impression cylinder of a following printing unit. However, in the case of perfecting printing, the front-end gripper of the double-diameter cylinder passes through the above-described contact point while gripping the sheet, and then delivers the rear edge of the sheet to the reversing gripper of the reversing cylinder when the rear-end gripper reaches the above-described contact point, whereupon the reversing gripper delivers the sheet to the impression cylinder of a following printing unit after the sheet is reversed as the reversing cylinder rotates.

Therefore, such reversing gripper apparatus provided on the reversing cylinder differs from those provided on the double-diameter and paper transfer cylinders which only carry out paper receiving and delivery and thus requires suitable opening-closing operations (gripping and releasing) corresponding to to both the case of one-side printing and the case of perfecting printing, as well as a reversing function for paper in perfecting printing, so that there is a need for consideration of an arrangement which entirely differs from that of other grippers.

With regard to the reversing gripper, U.S. Patent publication No. 3,537,391 discloses an art wherein two pairs of rotatable tumbler grippers are adjacently provided in a reversing cylinder. In this prior art, only one of the two pairs of tumbler grippers is driven in one-side printing and the other of the pairs is completely stopped. However, in perfecting printing, one of the pairs of tumbler grippers receives the rear edge of a sheet, the other tumbler gripper being caused to grip the rear edge of the sheet to effect delivery, whereby the sheet is delivered to the impression cylinder of a following printing unit after the sheet is reversed as the reversing cylinder rotates.

However, this prior art involves a situation where the function of gripping paper between the two pairs of tumbler grippers provided in the revering cylinder should be changed in one-side printing. Thus there is an increase in the number of times that sheet is delivered, and this consequently produces disadvantages in terms of delivery error and reduction in register accuracy.

In addition, the tumbler grippers which rotate as a combination of the grippers and the gripper pads have poor reliability in terms of the gripping function because the gripper pads are not fixed.

Furthermore, since the two pairs of tumbler grippers rotate in the circumferential direction of the reversing cylinder, errors produced in the stop positions of these tumbler grippers will translate as a register error with respect to the sheet and will subtly affect the quality of printing.

Other representative prior arts relating to the reversing gripper apparatus, West Germany patent application No. P2414998.2 and U.S. Pat. No. 3,899,970, disclose reversing grippers which comprise two combined grippers rotatable around a common shaft. One of these combined grippers operates as a gripper and the other as a gripper pad, the combined grippers rotating around a common axis and reversing the sheet in perfecting printing.

However, in an analysis of the prior arts from the viewpoint of gripping function, it is found that since the sheet is separately swung by an opening and closing mechanism at each time of gripping and releasing, the position relative to the gripper pads of the cylinder which is the object of receiving and delivery is easily moved, so that there is some difficulty in obtaining an accurate receiving and delivery operation and instability with respect to the register accuracy.

In an analysis of the gripping force, since the prior arts are so constructed that a spring is interposed between the combined grippers to produce the gripping force and the combined grippers are operated by an opening-closing control mechanism comprising a member such as a segment gear which acts against the force of the spring, it is impossible to make the spring any stronger than a definite limit which is defined by the opening-closing control mechanism or ultimately to set the gripping force at a sufficiently large value.

In addition, sheets of various thicknesses are used in a printing press, and thus, particularly when the sheet employed is thick, any discrepancy in the position of the gripper point is inevitably increased between the combined grippers and the grippers of the opposite cylinder in the radial direction thereof. Consequently, a wavelike difference in height is produced at the gripping position (namely, the edge) of the sheet, resulting in the occurrence of such printing problems as doubling and poor register.

During the reversing operation, the combined grippers cooperatively deliver the sheet to the grippers of the opposite cylinder, and thus it is difficult to ensure the positional accuracy of the combined grippers, do that there is a need for a fine regulating operation.

SUMMARY OF THE INVENTION

In consideration of the problems in the first prior art, i.e. the tumbler gripper, it is desirable to reverse a sheet without involving any changing of the gripping function, as is the case of the combined grippers of the second prior art, in order to avoid increasing the frequency of paper delivery.

For the purpose of assuring the gripping function and stabilization thereof, it is desirable to arrange for a sheet to be gripped by closing the gripper against the gripper pad fixed to the reversing cylinder, even in perfecting printing.

In addition, for the purpose of attaining an increase in register accuracy, it is desirable that a gripper pad which is capable of becoming a standard for register is constantly fixed to a definite position of the reversing cylinder.

In consideration of the problems of the combined grippers employed in the second prior art, the gripper pad is desirably fixed with regard to register accuracy, as has previously been known.

To set the gripping force at a large value, it is desirable that only the grippers are energized and pressed against the gripper pads fixed to the reversing cylinder.

Furthermore, it is necessary to carry out countermeasures for such problems as the inconvenience caused by increases in paper thickness and the difficulty experienced in the fine regulating operation of the gripper point.

Therefore, it is a main object of the present invention to obtain a reversing gripper apparatus of an improved one-side and perfecting printing press.

It is another object of the present invention to obtain a reversing gripper apparatus with an excellent gripping function.

It is still another object of the present invention to obtain a reversing gripper apparatus with excellent register accuracy.

It is a further object of the present invention to obtain a reversing gripper apparatus which is capable of applying a large gripping force.

In addition, a reversing gripper apparatus to which the invention relates can effect reversing by means of a simple structure and needs no fine regulating operation likely to cause trouble.

In a reversing gripper apparatus to which the invention relates, the gripper pad is so formed as to be absolutely fixed to the circumference of the reversing cylinder. This gripper pad includes a receiving part for gripping a sheet in cooperation with gripper members, as well as a space for withdrawing one component member of the gripper members.

The gripper members for gripping a sheet in cooperation with the gripper pad comprise a combination of a master gripper provided on a common shaft and an auxiliary gripper opposed to this master gripper. The master gripper is so formed as to have a wide gripper capable of covering the receiving part of the gripper pad as well as the gripper tip of the auxiliary gripper and is controlled by the common shaft such as to be able to swing and rotate.

The auxiliary gripper opposed to only one part of the width of the master gripper is controlled by another controlling member such as to be able to swing and rotate around the common shaft. The auxiliary gripper cooperates with the master gripper only in perfecting printing, being withdrawn within the space provided in the gripper pad and having no function in one-side printing.

That is to say, in one-side printing, only the master gripper cooperates with the gripper pad to effect the receiving/delivery of the front edge of sheet, the auxiliary gripper being withdrawn within the space and having no active function.

However, in perfecting printing, the master and auxiliary grippers cooperate with each other to receive the rear edge of the sheet in the receiving situation, and are then transferred to the paper-gripping situation in cooperation with the receiving part of the gripper pad after they rotate as a unit around the common shaft and reverse the sheet. Then, the rear edge of the sheet is delivered to the impression cylinder of the next printing unit in a state wherein the auxiliary gripper is withdrawn within the space, and thus the master gripper and the gripper pad grip the rear edge of the sheet.

In the reversing gripper apparatus for a one-side/perfecting printing press to which the present invention relates, the main function is effected in a superior fashion without any changing of the gripping function, the gripper pad being substantially fixed, so the gripping function, register accuracy and gripping force are extremely good. The increase in paper thickness produces no wavelike difference in height and there is no need for finely regulating the position of the gripper point. Furthermore, this reversing gripper has a relatively simple structure and it is possible to simplify the structure of the gripper apparatus of the opposed cylinder. In conclusion, the various problems experienced with the conventional reversing gripper apparatus may be thus resolved at a stroke.

Further objects will be obvious from the description with reference to the appended drawings. The drawings show just one embodiment of this invention but the invention is by no means limited to this.

DETAILED DESCRIPTION OF EMBODIMENT

An embodiment of the present invention will be described below with reference to the drawings.

Figure 1:
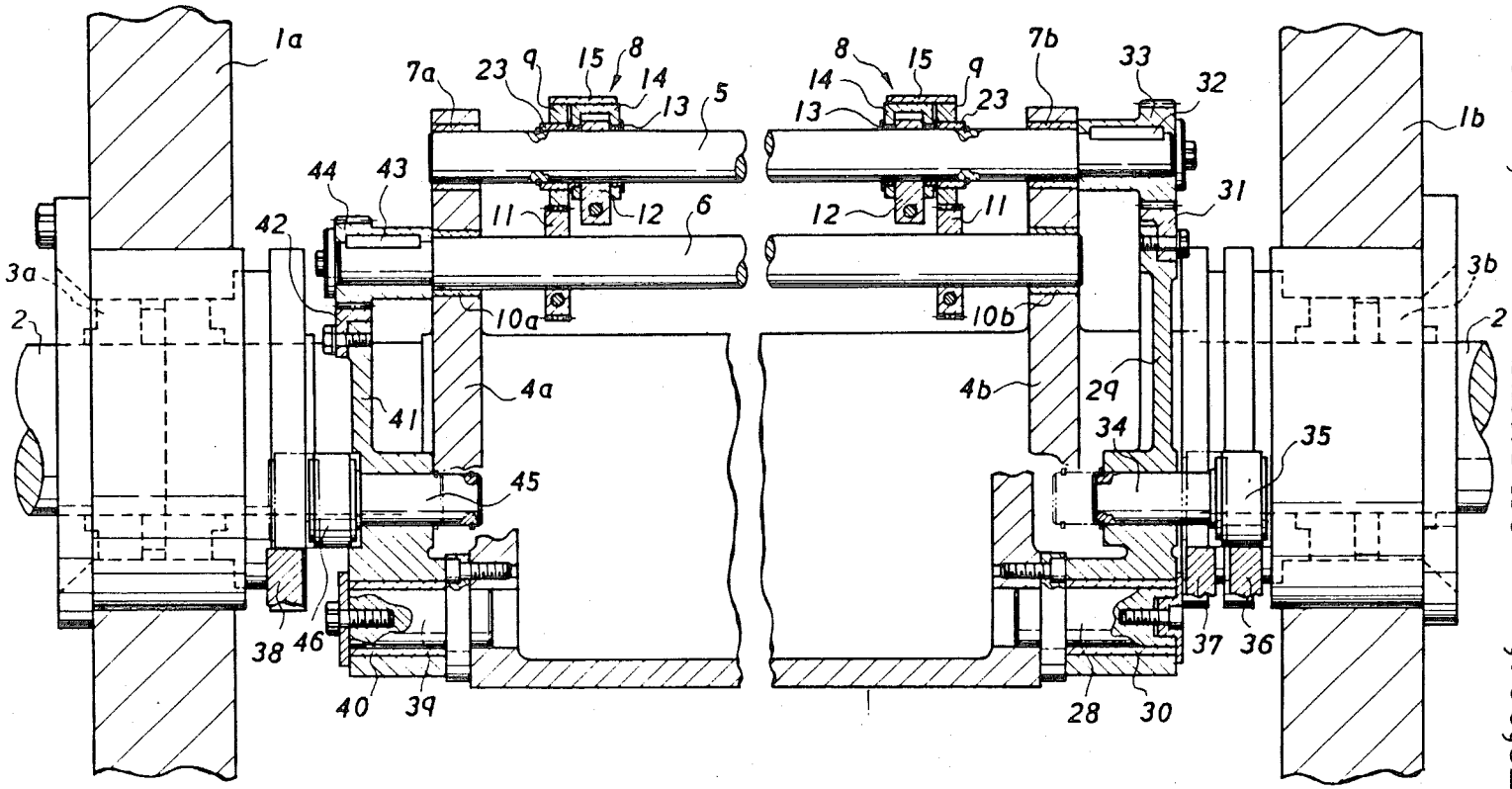
FIG. 1 is a cross-sectional view of the reversing cylinder provided with the reversing gripper apparatus to which the present invention relates.

In FIG. 1, reference numerals 1*a* and 1*b* denote side walls of a printing press, and the shaft 2 of a reversing cylinder is rotatably provided between the side walls 1*a* and 1*b* through bearings 3*a* and 3*b* being disposed in the transverse direction. A pair of shoulders 4*a* and 4*b* of the reversing cylinder are disposed on both sides of the shaft 2, the shoulders acting as bases for mounting a gripper shaft 5 and an auxiliary gripper controlling shaft 6. In FIG. 1, it will be apparent that the intermediate portion of the reversing cylinder is largely omitted.

The gripper shaft 5 is rotatably provided between the shoulders 4*a* and 4*b* through the bearings 7*a* and 7*b*, is disposed in the transverse direction, is parallel to the shaft 2, and acts as a common shaft for many gripper members each comprising a combination of a master gripper 8 and an auxiliary gripper 9. The auxiliary gripper control shaft 6 is rotatably provided between the shoulders 4*a* and 4*b* through the bearings 10*a* and 10*b*, us disposed in the transverse direction in parallel with the gripper shaft 5 and is adapted to act as the mounting shaft of a control gear 11 for controlling the auxiliary gripper 9.

Figure 2:
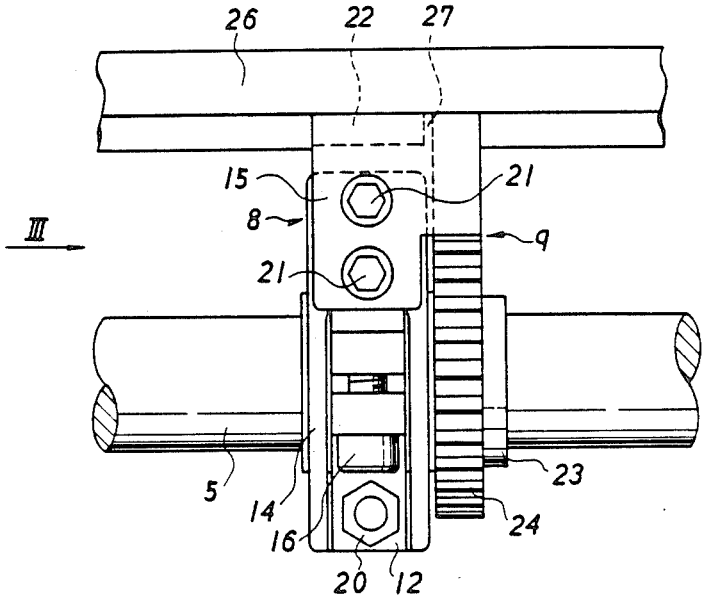
FIG. 2 is an enlarged plan view of the main part of FIG. 1.
Figure 3:
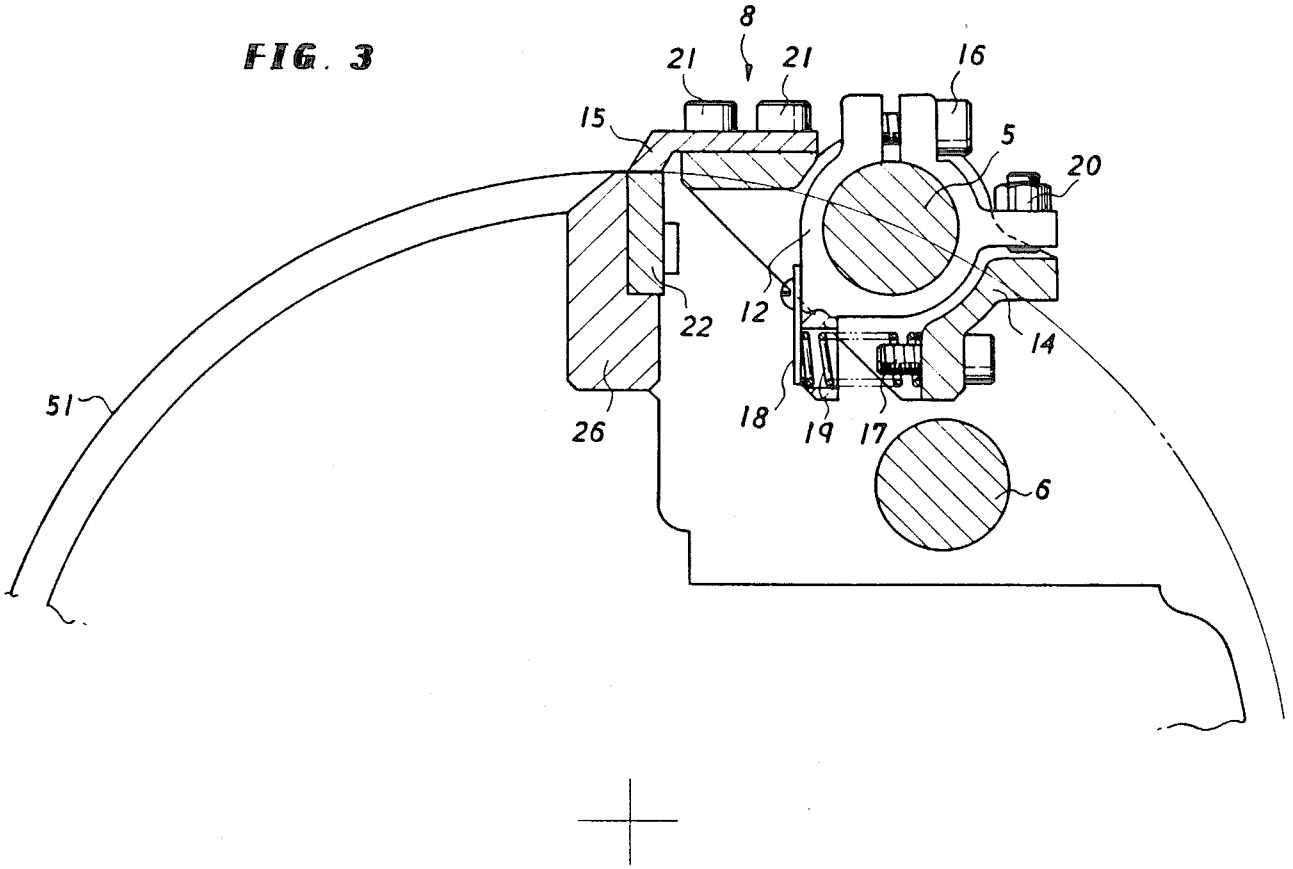
FIG. 3 is a partially croos-sectional view as viewed in the direction of the arrow III shown in FIG. 2.

The master gripper 8 of the gripper members, as exactly shown in FIGS. 2 and 3, mainly comprises a bracket 12 which is fixed to the gripper shaft 5 by being tightended therearound, a gripper holder 14 rotatably provided on the gripper shaft 5 through a bearing 13, and a master gipper body 15 fixed to the gripper holder 14. More specifically, the bracket 12 is fixed to the gripper shaft 5 by tightening a bolt 16 and the gripper holder 14 which holds the bracket 12 therein (refer to FIG. 2) is rotatably provided on the gripper shaft 5 through the bearing 13. A spring 19 is interposed between the guide bolt 17 of the gripper holder 14 and the stopper plate 18 of the bracket 12 and urges the gripper holder 14 counterclockwise as viewed in FIG. 3 (the direction in which the master 8 gripper is closed). Reference numeral 20 denotes a regulating screw for adjusting the aperture between the screw and the gripper holder 14 and thus the timing of the opening of the master gripper 8. The master gripper body 15 is fixed to the gripper holder 14 by mounting bolts 21, as most exactly shown in FIG. 2, and extends toward the side of the auxiliary gripper 9 adjacent to the master gripper 8, thus effectively having a width sufficient to cover the receiving portion 22 of the gripper pad and the point of the auxiliary gripper 9. The auxiliary gripper 9 is, as most precisely seen in FIGS. 2 and 4, rotatably provided through a bush 23 on the gripper shaft 5 which is the common shaft. The mounting position of the auxiliary gripper 9 is parallel to the master gripper 8, as shown in the drawings, but this is not limitative. Though the point of the auxiliary gripper 9 is opposed to the master gripper body 15 for the purpose of cooperation, as conversely considered from the viewpoint of the master gripper body 15, only a part of the master gripper body 15 cooperates with the point of the auxiliary gripper 9 and the other parts are solely provided for cooperation with the receiving portion 22 of the gripper pad. A gear portion 24 is formed around part of the circumference of the auxiliary gripper 9. This gear portion 24 is engaged with a control gear 11 fixed to the auxiliary gripper control shaft 6 by a bolt 25. Of course, it is also feasible the auxiliary gripper 9 shown in FIG. 4 to be made more complicated and so formed as to be divided into two parts, i.e. the gripper part and the gear part, and to be engaged with the control gear 11.

Figure 4:
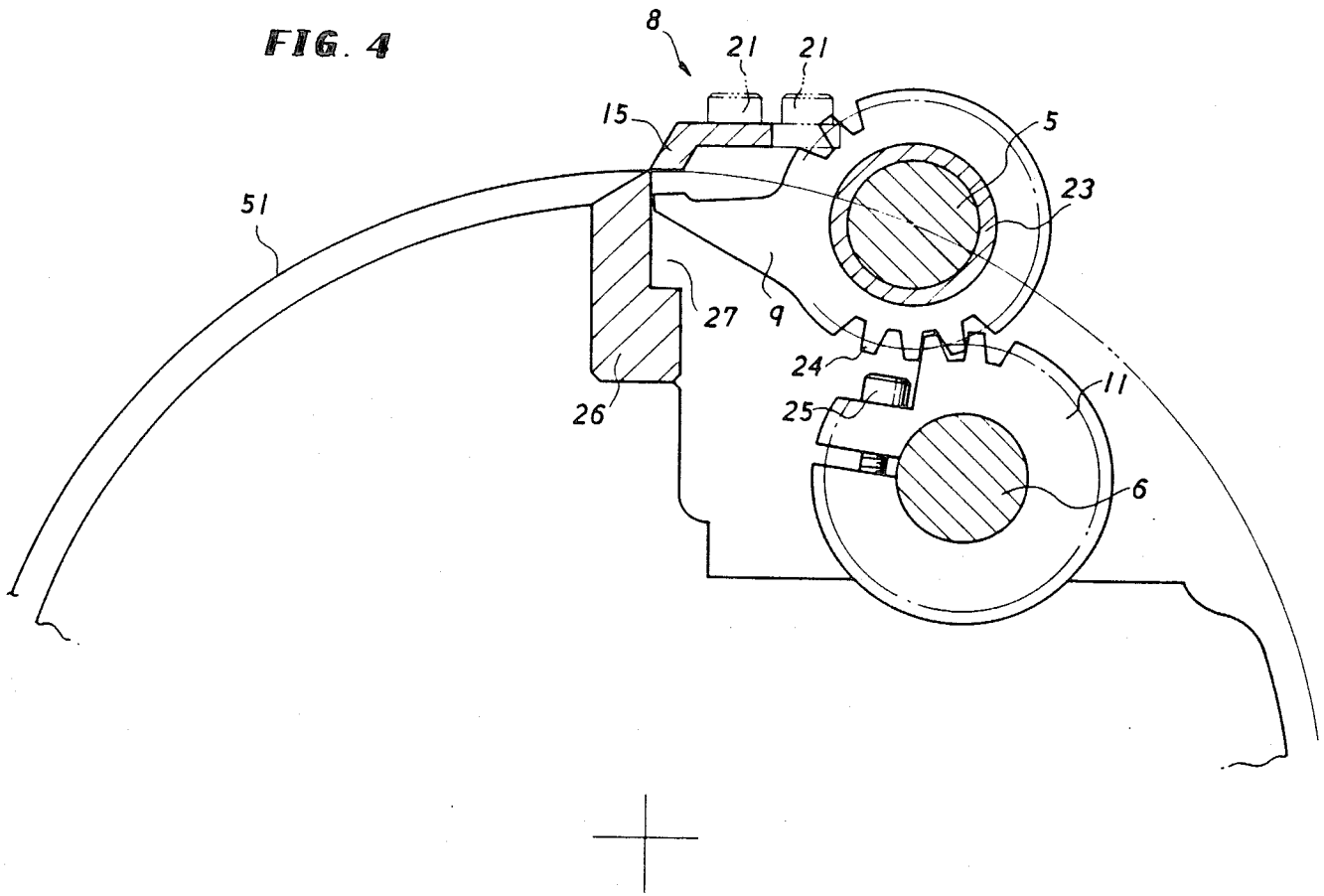
FIG. 4 is a sectional view mainly showing the auxiliary gripper shown in FIG. 2.

The gripper pad is shown in FIGS. 2 to 4 gripping a sheet of paper together with the master gripper 8 but cannot be shown in FIG. 1. However, the gripper pad is naturally provided on the reversing cylinder and, in the present invention, is so formed as to be "fixed" to the circumference of the reversing cylinder in an absolute sense, as most exactly shown in FIG. 3. That is to say, the gripper pad is fixedly provided on the circumference of the reversing cylinder in the longitudianal direction thereof (that is the axial direction of the reversing cylinder) as one gripper pad bar member 26 secured by bolts or similar (not shown). The present invention is particulaly characterized in that the gripper pad bar member 26 is not only related to the master gripper 8, but also to the auxiliary gripper 9. The gripper pad bar member 26, as shown in FIG. 3, has a receiving portion 22 forgripping a sheet of paper together with the master gripper body 15, as well as having a space 27 for accommodating the point of the auxiliary gripper 9. Therefore, the receiving portion 22 and space 27 are respectively engaged to correspond with the master gripper 8 and the auxiliary gripper 9 as shown in FIG. 2. The width and depth of the space 27 are suitably dimensioned such as to accommodate the auxiliary gripper 9. The master gripper 8, the auxiliary gripper 9, and the receiving portion 22 are subjected to a super-hardening treatment sufficient to allow them to effect the gripper function.

Next, the operative mechanism of the common gripper shaft 5 will be described. In FIG. 1, an arm shaft 28 is fixed to the shoulder 4*b* on the right side of the drawing, and one end of a cam arm 29 is rotatably provided on the arm shaft 28 through a bearing 30. The cam arm 29 provided on the external circumference of the shoulder 4*b* has a sector gear 31 on the other end thereof and this sector gear 31 is engaged with a gripper shaft gear 33 fixed to the end of the gripper shaft 5 by a key 32. What causes the cam arm 29 to conduct a given movement is a cam roller 35 provided on a roller shaft 34 and this cam roller 35 is elastically connected to a one-side printing cam 36 by a spring (not shown) in the state shown in the drawing. The one-side printing cam 36 and a perfecting printing cam 37 are fixed to the side wall 1*b* concentrically with respect to the shaft 2 of the reversing cylinder and the objective cams are changed by axially moving the roller shaft 34 of the cam roller 35, depending upon the desired printing format.

On the other hand, the operative mechanism of the auxiliary gripper control shaft 6 is different from the case of the gripper shaft 5 in that the auxiliary gripper 9 is operated only in perfecting printing and thus only has a perfecting printing cam 38. An arm shaft 39 is fixed to the shoulder 4*a* on the left side as viewed in FIG. 1 and one end of a cam arm 41 is rotatably provided on the arm shaft 39 through a bearing 40. A sector gear 42 is provided on the other end of the cam arm 41 and this sector gear 42 is engaged with a gear 44 fixed to the end of the auxiliary gripper control shaft 6 by a key 43. The cam arm 41 is provided with a roller shaft 45 and the cam roller 46 provided on the end of this roller shaft 45 is elastically connected to the perfecting printing cam 38 such as to be capable of being rolled thereon by the action of a sping (not shown). However, since FIG. 1 shows the the state assumed with one-side printing, the cam roller 46 has no object cam and does not make contact with the perfecting printing cam 38 till the roller shaft 45 is axially moved in the case of perfecting printing. That is to say, in the case of one-side printing, the cam arm 41, the auxiliary gripper control shaft 6, and the auxiliary shaft 9 are entirely stopped. The perfecting printing cam 38 is also fixed to the side wall 1*a* concentrically with respect to the shaft 2.

Figure 5:
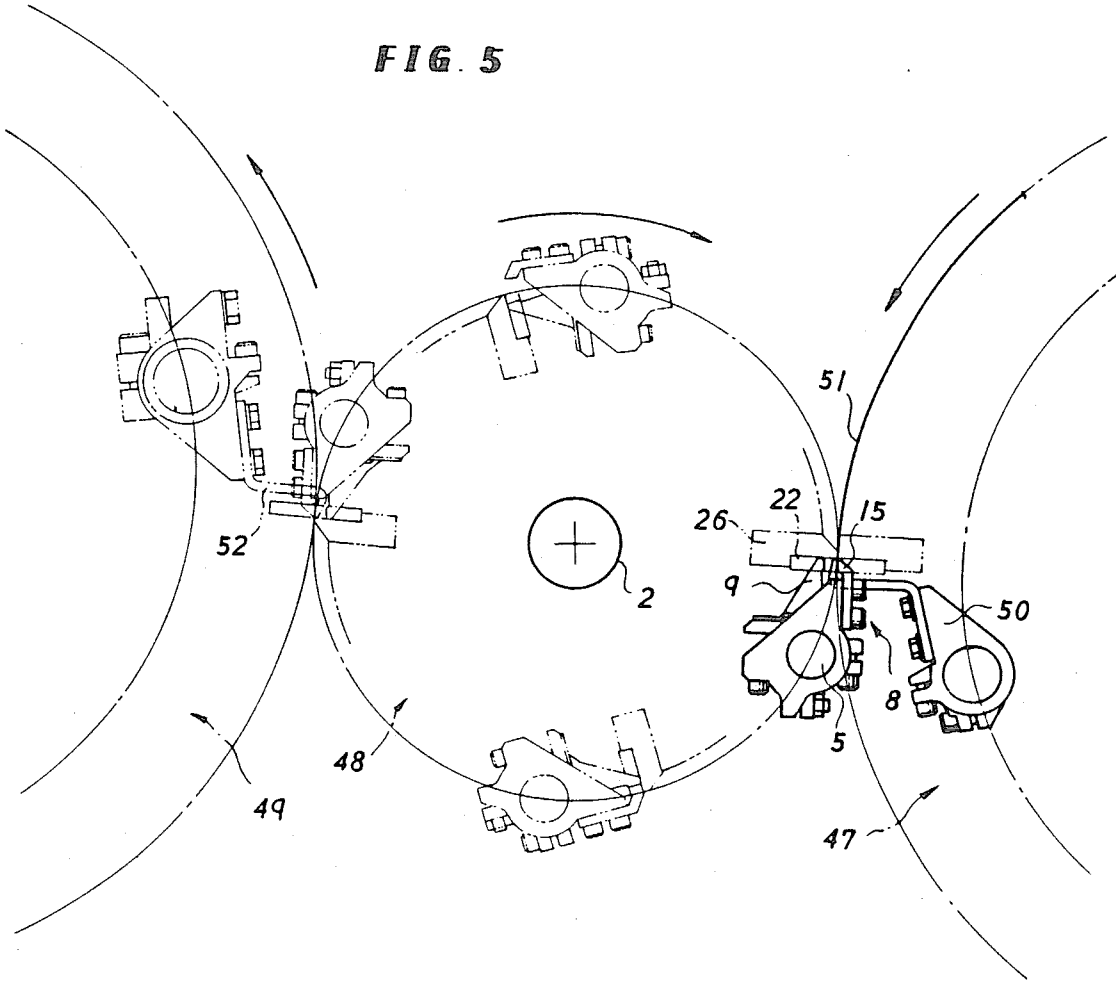
FIG. 5 is an explanatory view showing the operation of the reversing gripper apparatus in the case of one-side printing.
Figure 6:
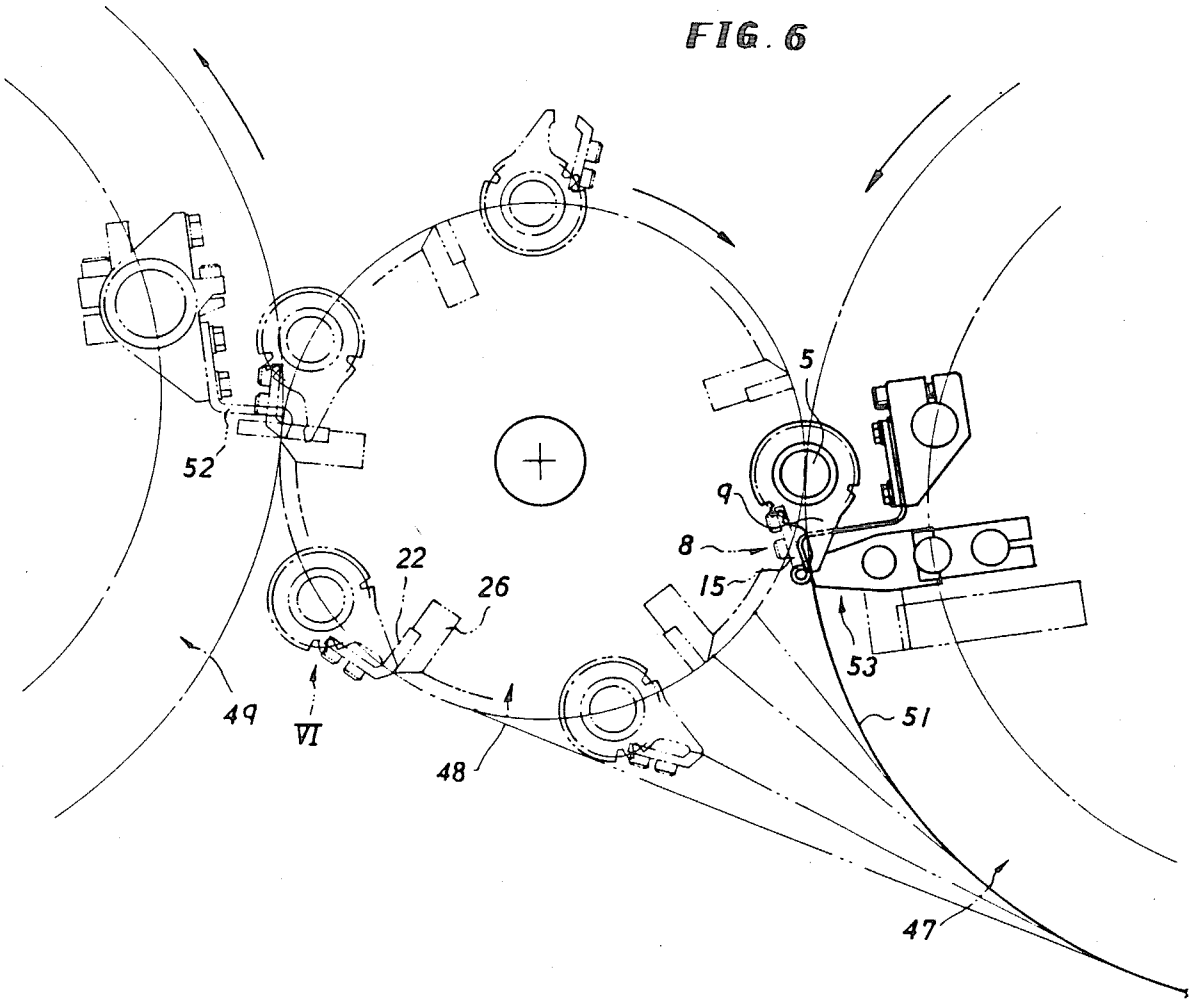
FIG. 6 is a partially croos-sectional explanatory view showing the operation of the reversing gripper apparatus in the case of perfecting printing.
Figure 7:
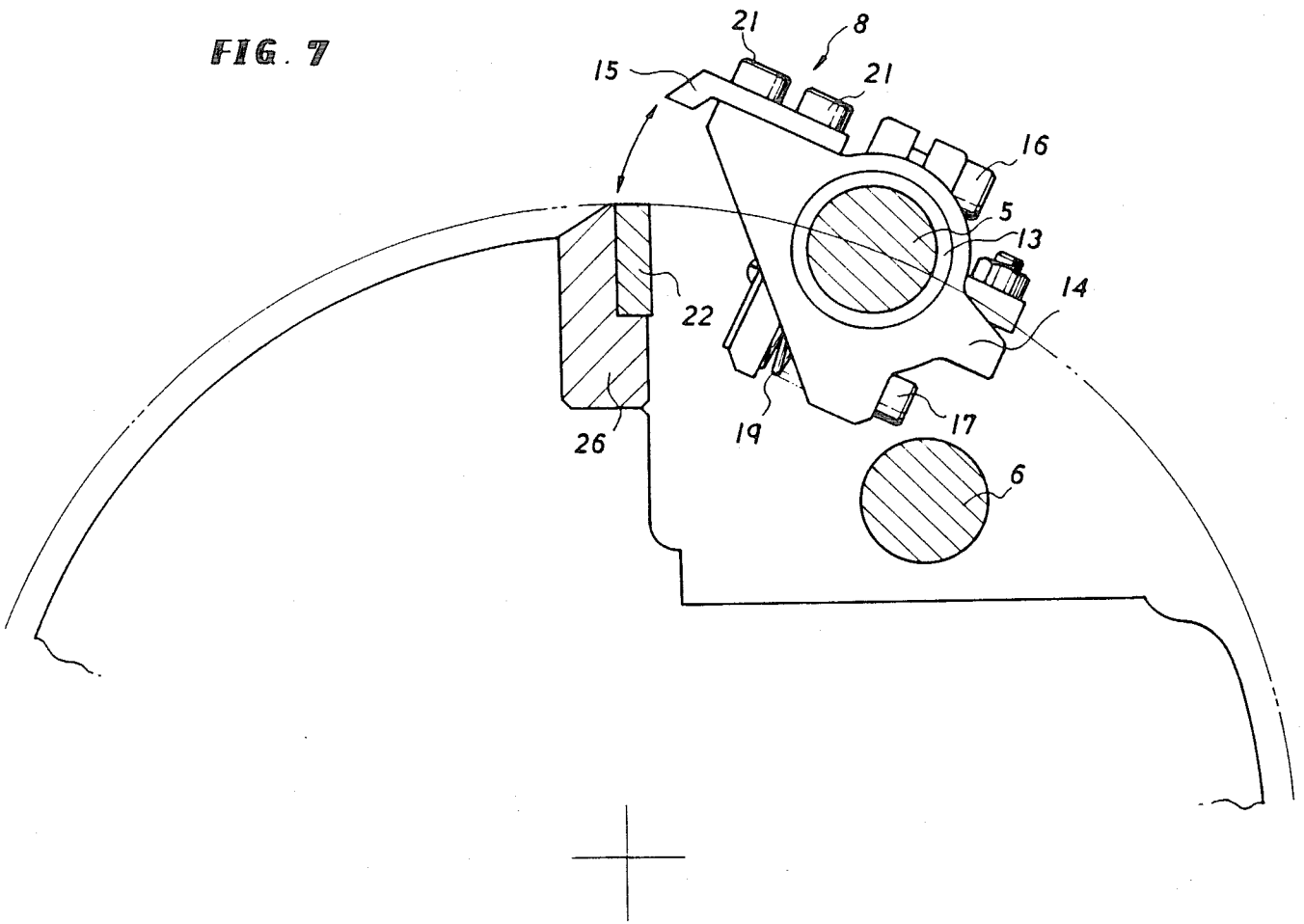
FIG. 7 is an explanatory view showing the state where a master gripper is separated from the gripper pad and taken along a line which differs from the cross-sectional view FIG. 3.

Next, the operation of the apparatus will be described. FIG. 5 shows the situation at the time of the receiving/delivery of paper in the case of one-side printing and FIG. 6 shows the same in the case of perfecting printing. In these drawings, reference numeral 47 indicates a double-diameter cylinder, reference numeral 48 a reversing cylinder, and reference numeral 49 an impression cylinder of a following printing unit, which are respectively rotated in the directions shown by the arrows in the drawings.

First, in the case of one-side printing which can be said to operate under very simple conditions, the front edge of a sheet of paper 51 which is gripped by a front-end gripper 50 of the double-diameter cylinder is delivered between the master gripper 8 of the reversing cylinder 48 and the receiving portion 22 at the point of contact with the reversing cylinder. Then, the master gripper 8 and the receiving portion 22 grip the front edge of the sheet 51 in the state shown in FIG. 3 and they deliver the sheet 51 to a gripper 52 of the impression cylinder 49 of the next printing unit at the point of contact with the impression cylinder 49 in the same state. Thus, in this state, the auxiliary gripper 9 is entirely stopped as shown in FIG. 4, and its gripper point remains withdrawn within the space 27. Therefore, the operative mechanism relative to the auxiliary gripper 9 includes no one-side printing cam. On the other hand, in the operative mechanism related to the master gripper 8, the force for operating the master gripper 8 is transmitted as described above, that is from the one-side printing cam 36 to the gripper holder 14 via the following parts: the cam roller 35, the roller shaft 34, the cam arm 29, the sector gear 31 the gripper shaft gear 33, the gripper shaft 5, the bracket 12 and the spring 19.

Figure 8:
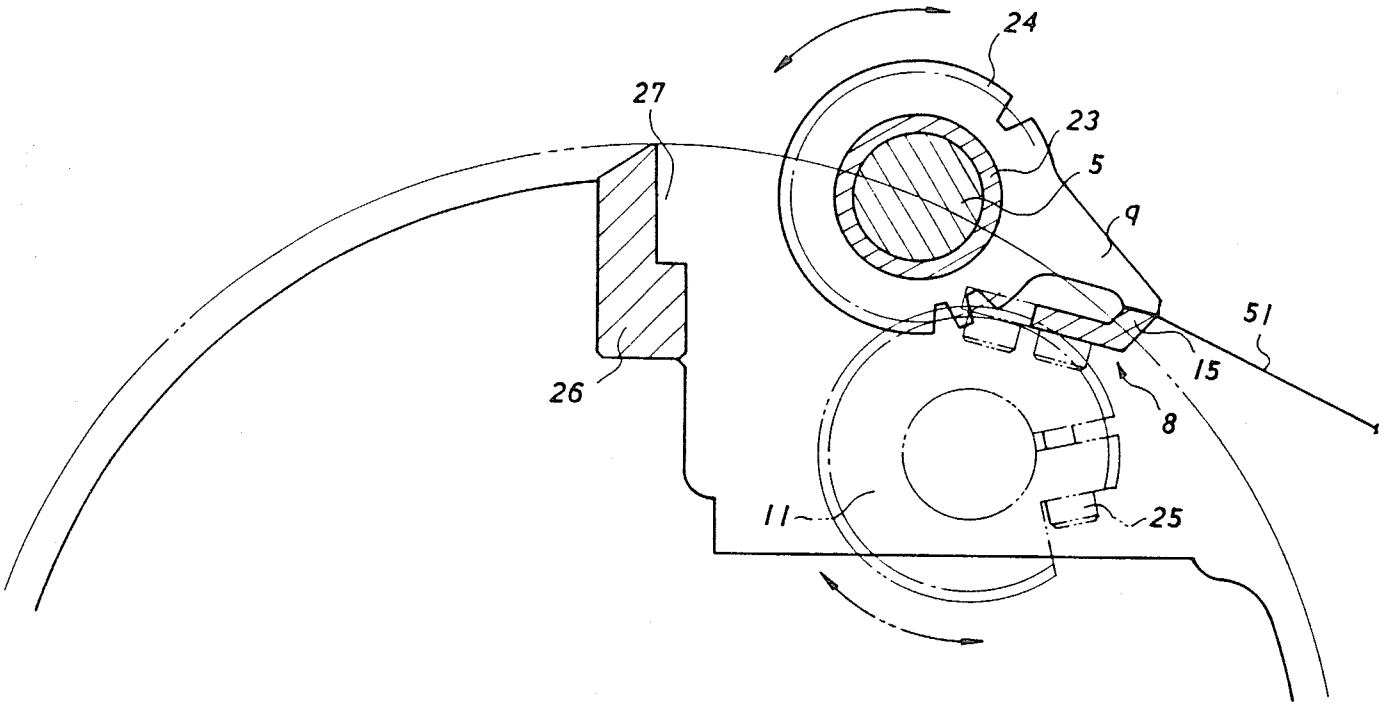
FIG. 8 is an explanatory cross-sectional view showing the state where the master and auxiliary grippers cooperate with each other and grip the rear edge of a sheet of paper.
Figure 9:
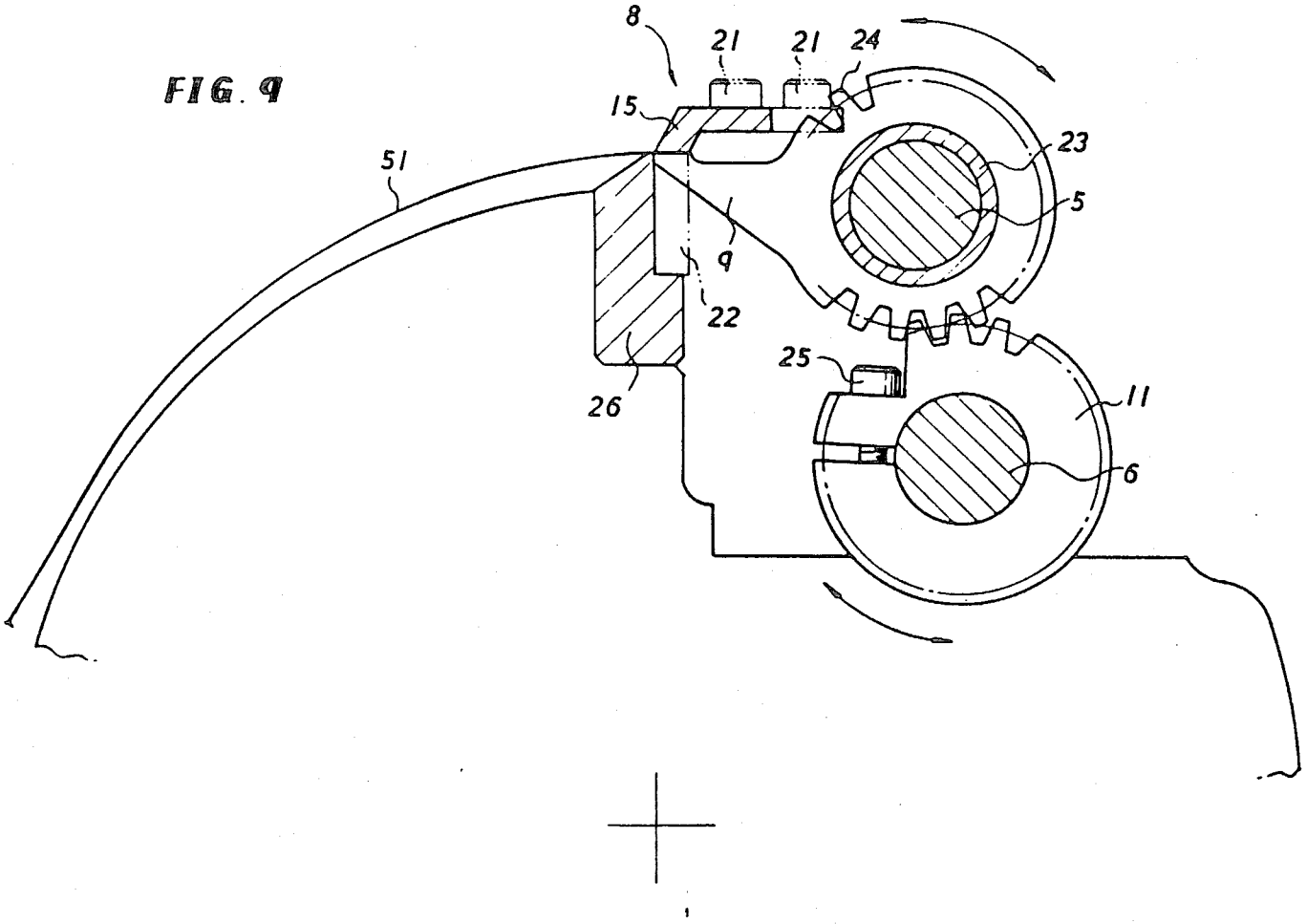
FIG. 9 is a view showing the state where the master and auxiliary grippers gripping the rear edge of the sheet rotate and the master gripper is seated in the gripper pad.

However, in the case of perfecting printing, the cam roller 35 on the side of the master gripper 8 and the cam roller 46 on the side of the auxiliary gripper 9 are moved to the perfecting printing cam 37 and the perfecting printing cam 38 so as to elastically contact them, respectively, and thus the master gripper 8 and the auxiliary gripper 9 are moved in a manner entirely different from each other. Namely, referring to FIG. 6, when the rear-end gripper 53 of the double-diameter cylinder 47 is moved to the contact point while holding the rear edge of the sheet 51, the master gripper 8 and the auxiliary gripper 9 recieve the rear edge of the paper cooperation with each other (refer to FIG. 8). While gripping the rear edge, the master gripper 8 and the auxiliary gripper 9 are then rotated by the common gripper shaft 5 during the rotation of the reversing cylinder 48. After the sheet 51 is reversed by this rotation, the grippers 8 and 9 reach the place where the grippers 8 and 9 are seated in the receiving portion 22 in cooperation with each other, as shown by the symbol VI in FIG. 6 and also shown in FIG. 9. Consequently, the sheet 51 is gripped by the master gripper 8 and the receiving portion 22 with no occurrence of register error. Thus, the auxiliary gripper 9 first finishes its action in one transfer cycle and is then withdrawn within the space 27, as shown in FIG. 4. Therefore, the rear edge of the sheet 51 is delivered to the gripper 52 of the impression cylinder 49 of the next printing unit in the state of being gripped by the master gripper 8 and the receiving portion 22, as is the case in one-side printing. Thereafter, the master gripper 8 and the stopped auxiliary gripper 9 are rotated for the next transfer cycle. The transmission of the force in the operative mechanism of the master gripper 8 is carried out only by changing the object cam and the operative mechanism of the auxiliary gripper 9 is different from the master gripper 8 in its style of movement, but is the same as the master gripper 8 with regard to the transmission of force, its description therefore being omitted.

The present invention is not limited to the embodiment described above and various additions to and changes of the invention are possible.

What is claimed is:

1. A reversing gripping apparatus for a one side and perfecting printing press, said printing press comprising a first impression cylinder and a second impression cylinder and a reversing cylinder for transferring a sheet of paper from said first to said second cylinder, said reversing cylinder having substantially half the diameter of said first and second cylinders, said gripping apparatus comprising;

a channel formed in the circumference of said reversing cylinder and parallel to the axis thereof;

a common shaft rotatably mounted in said channel;

a master gripper mounted on said shaft for rotation therewith, said master gripper having a gripping tip;

a gripper pad fixedly mounted to a side wall of said channel;

first means for rotating said shaft to grip a front edge of said sheet of paper between said gripping tip of said master gripper and said gripper pad during one side printing;

an auxiliary gripper rotatably mounted on said shaft and having a gripping tip opposed to and a width narrower than said gripping tip of said master gripper, said gripping tip of said auxiliary gripper being recesssed in a space in said gripper pad substantially parallel to a depth of said side wall;

second means operable only during perfecting printing and separate from said first means, for rotating said auxiliary gripper independent of said master gripper, for gripping a rear edge of said sheet of paper between said gripping tip of said auxiliary gripper and said gripping tip of said master gripper, said first means rotating said master gripper and said second means rotating said auxiliary gripper as said reversing cylinder rotates so that said gripping tip of said auxiliary gripper is recessed in said space and said rear edge of said sheet of paper is gripped between said gripping tip of said master gripper and said gripper pad;

whereby said sheet of paper is delivered to said second cylinder by said master gripper and said gripping pad with increased registration accuracy.

2. A reversing gripper apparatus according to claim 1 wherein said master gripper comprises a gripper body attached to said common shaft by a gripper holder, said master gripper and said auxiliary gripper being arranged in a line on said common shaft, said master gripper body being of sufficient width to cover a point of said gripping tip of said auxiliary gripper.

3. A reversing gripper apparatus according to claim 1 wherein a gear part is formed in the external circumference of said auxiliary gripper and a control gear is mounted on an auxiliary gripper control shaft provided in parallel with said common shaft; said gear part being engaged with said control gear.

* * * * *